US006448515B1

(12) United States Patent
Rohmer et al.

(10) Patent No.: US 6,448,515 B1
(45) Date of Patent: Sep. 10, 2002

(54) ELECTRICAL SWITCHING DEVICE WITH FUSED MECHANICAL INTERLOCK

(75) Inventors: Richard Rohmer, Jordan; Mary Alice Dailor; Bradley David Gale, both of Rochester; Scott Phillips, West Henrietta, all of NY (US)

(73) Assignee: Pass & Seymour, Inc., Syracuse, NY (US)

( * ) Notice: Subject to any disclaimer, the term of this patent is extended or adjusted under 35 U.S.C. 154(b) by 29 days.

(21) Appl. No.: 09/746,426

(22) Filed: Dec. 21, 2000

(51) Int. Cl.[7] ..... H01H 9/20

(52) U.S. Cl. ..... 200/50.28; 200/50.12

(58) Field of Search ..... 200/50.01, 50.07, 200/50.11, 50.27–50.32, 50.12; 337/2–7, 142–146

(56) References Cited

U.S. PATENT DOCUMENTS

| | | | | | |
|---|---|---|---|---|---|
| 1,556,829 | A | * | 10/1925 | Wyman | 200/50.31 X |
| 1,606,890 | A | * | 11/1926 | Murray et al. | 200/50.28 |
| 3,264,433 | A | * | 8/1966 | Clark, Jr. et al. | 200/50.28 |
| 4,305,610 | A | * | 12/1981 | Piteo et al. | 200/50.07 |
| 4,496,916 | A | * | 1/1985 | Carpenter et al. | 337/6 |
| 4,553,000 | A | * | 11/1985 | Appleton | 200/50.29 |
| 5,298,701 | A | * | 3/1994 | Sandor | 200/50.31 |
| 5,680,926 | A | * | 10/1997 | Sandor et al. | 200/50.11 |
| 5,880,420 | A | | 3/1999 | Rohmer et al. | 200/50.28 |

* cited by examiner

*Primary Examiner*—J. R. Scott
(74) *Attorney, Agent, or Firm*—Wall Marjama & Bilinski LLP

(57) ABSTRACT

A fused mechanical interlock in an electrical switching device precludes a fuse access door from being open when the switching device is energized. The fused mechanical interlock optionally cooperates with a plug interlock mechanism which prevents the switching device from being energized unless a plug is properly inserted in a receptacle.

30 Claims, 9 Drawing Sheets

ELECTRICAL SWITCHING DEVICE WITH FUSED MECHANICAL INTERLOCK

FIELD OF THE INVENTION

The present invention relates to a high current electrical switching device with a mechanical interlock, and in particular, to an electrical switching device with a mechanical interlock that prevents the device from being energized while a fuse access door to the device is open.

BACKGROUND OF THE INVENTION

The use of equipment including industrial processors requiring relatively high currents is becoming increasingly common. In the powering of such equipment, it is considered unsafe to allow a switch to be moved to the ON position in the absence of a properly inserted plug. Attempting to insert or remove a plug from an energized receptacle, especially with a load connected to the plug, can result in arcing between the plug and receptacle with damage to the components as well as creating a substantially safety hazard to personnel. To prevent this occurrence, switches are often enclosed within a housing and commonly provided with some type of interlock mechanism.

U.S. Pat. No. 5,298,701 (Sandor) discloses a high current switch operator mounted in a closed housing having a switch and a receptacle, wherein the housing includes an interlock mechanism to prevent operation of the switch to the ON position unless a plug is properly inserted in the receptacle. A face mounted handle is attached to a shaft which directly turns a gear (designated the second gear) which carries the interlocking components.

U.S. Pat. No. 5,880,420 (Rohmer et al.) discloses a mechanical coupling between a switch, switch operator and plug interlock mechanism, whereby the switch cannot be energized unless a plug having an external key is properly inserted and releases the plug interlock mechanism.

In electrical circuits, and particularly in electrical circuits which carry high currents, it is desirable to have fuses which can protect those circuits from electrical overload. An electrical fuse is intentionally designed to be the weakest point in an electrical circuit, so that in the event of an overload, it becomes overheated to the point that it safely blows and interrupts the circuit; otherwise, overheating at some other location, such as in a building wall, may start a fire. A blown fuse is an indicator that an overload exists, perhaps because a fault has developed in the electrical supply wiring, because some inappropriate electrical device is connected to the circuit, or because an otherwise appropriate electrical device is malfunctioning. Once the cause of an overload has been identified and corrected, it is necessary to replace a blown fuse with a new one. It is desirable to have the fuses at an accessible point in a circuit, and in particular it is convenient to locate the fuses in the same housing as a switch. There is a need to provide a mechanical interlock between the switch and a door, so that fuses located in a switch housing can be readily accessed, while precluding the possibility that access be gained while the circuit is energized, and further precluding the possibility that the circuit be energized once access has been gained.

SUMMARY OF THE INVENTION

Briefly stated, a fused mechanical interlock in an electrical switching device precludes a fuse access door from being open when the switching device is energized. The fused mechanical interlock optionally cooperates with a plug interlock mechanism which prevents the switching device from being energized unless a plug is properly inserted in a receptacle.

According to an embodiment of the invention, an electrical switching device includes a housing, an electrical switch for energizing an electrical circuit when the switch is closed and de-energizing the electrical circuit when the switch is open, a fuse block connected in series with the switch, a fuse access door in the housing providing access to the fuse block but not with the switch, and a mechanical interlock operably connecting the fuse access door and the switch, and preventing the switch from being closed when the door is open, and preventing the door from being opened when the switch is closed.

According to an embodiment of the invention, an electrical switching device which has a housing includes (a) an electrical switch with an OFF and an ON position wherein the device is respectively de-energized and energized, (b) an actuation gear coupled to the switch, © at least one fuse block designed to hold a fuse in series with the switch, (d) a fuse access door in the housing which provides the only access to the fuse block, access beyond the fuse block being precluded, (e) a door catch attached to the door, (f) a lockout disposed against a spring and cooperating with the door catch, and (g) a driver bar cooperating with the actuation gear and the lockout, wherein the driver bar is slidably mounted with respect to the housing so as to be selectably displacable between an OFF and an ON position, corresponding respectively with the OFF and ON positions of the switch, the bar includes a notch which aligns with the lockout when the bar is in the OFF position such that if the door is open the spring can urge the lockout upward so that a portion thereof engages with the notch, precluding the bar from moving to the ON position until the door is closed, and the bar further including a hooked portion so that when the bar is in the ON position and the door is closed, the hooked portion engages with the door catch and precludes the door from being opened.

DETAILED DESCRIPTION OF THE PREFERRED EMBODIMENT

Figure 1:
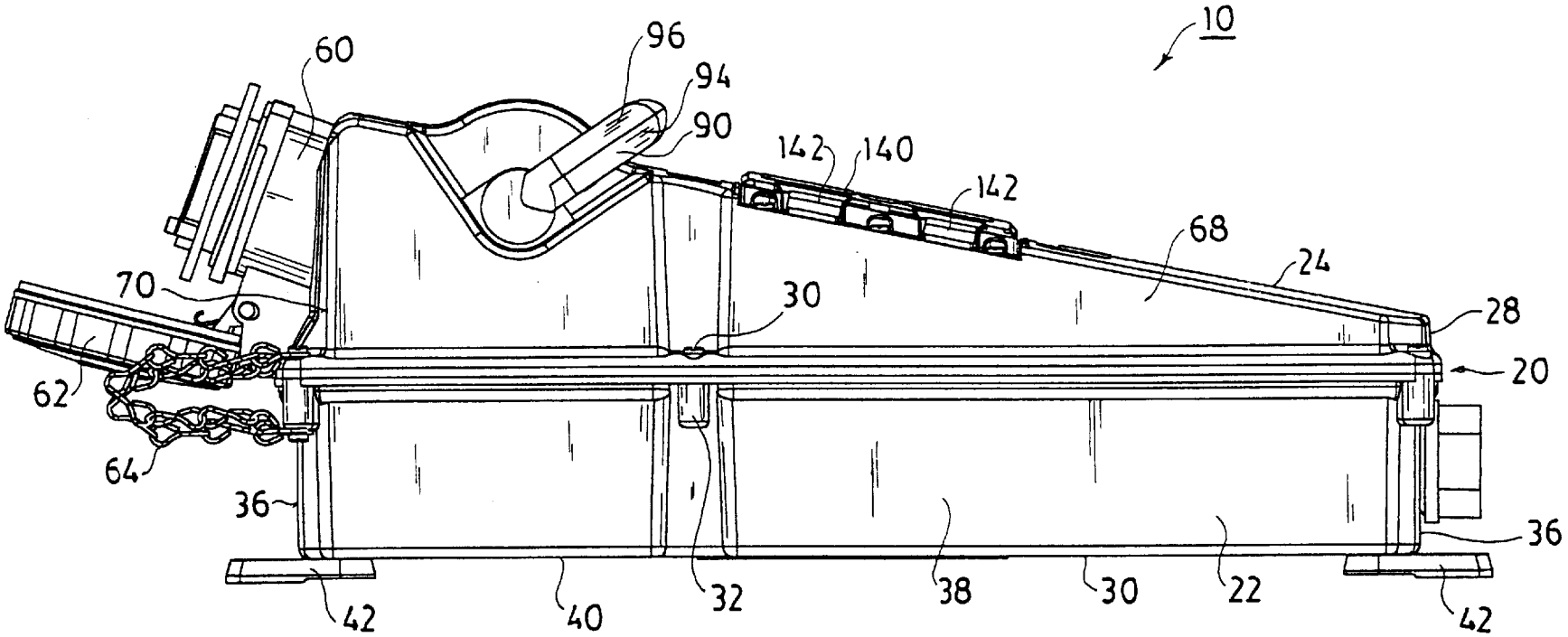
FIG. 1 is a side elevation view of an electrical switching device having a housing which includes a base and a cover, showing a switch handle, a receptacle and a fuse access door.

The present invention relates to an electrical switching device 10. In the following disclosure, various cooperating components of the device 10 will be described as being in an ON or an OFF position. Regardless of which component is referred to, it will be understood that ON and OFF refer to a condition wherein the device is electrically energized and de-energized, respectively.

Referring now to the drawings, FIGS. 1, 2, 3 and 4 show the device 10 with a housing 20 sized to enclose a switch 50 and a plug 60. A lever arm 80 is connected to the housing 20 and is movable between an ON and OFF position, cooperating with a device interlock mechanism 100 which selectively permits and precludes actuation of the switch 50, and further prevents a fuse access door 140 from being open whenever the device is energized.

The housing 20 includes a base 22 in the form of a generally rectangular box. A housing cover 24 sits atop the base 22; the cover 24 is generally rectangular when viewed from the top and has a generally triangular shaped side profile. The base 22 and housing cover 24 include corresponding seals and seal faces to provide a substantially liquid tight interface. One of the base 22 and housing cover 24 may include a peripheral recess into which a resilient seal is disposed, and the remaining one of the base 22 and cover 24 includes a corresponding seal face for contacting the seal. The base 22 and the housing cover 24 are fastened together with screws 30 which engage with fastening points 32 around the periphery of the base 22 and cover 24 to form a substantially water tight housing.

The base 22 has a rectangular periphery and includes a bottom wall 34, a pair of parallel opposed end walls 36, and a pair of parallel opposed side walls 38. A line port for connecting a power source is conveniently formed in one of the end walls 36. An outside surface 40 of the bottom wall 34 has thereon a plurality of self locking feet 42. Each foot 42 cooperates with a configured recess such that the frictional interface between the foot 42 and corresponding recess precludes rotation of the foot 42 relative to the base 22. The configuration in the recess includes a center post for mounting the foot 42. A threaded fastener such as a screw or a bolt may be passed through a portion of the foot 42 into the post to prevent unintended separation of the foot 42 from the base 22.

The housing cover 24 includes a generally rectangular face panel 66 and a pair of spaced apart side panels 68 extending from the face panel 66. The side panels 68 have a triangular periphery. A front panel 70 extends between the side panels 68 and interconnects the side panels 68 with the face panel 66. The front panel 70 includes the plug 60, wherein is located a receptacle 72. Within the housing cover is located a gear cover 26, shown in FIG. 2, which encases the device interlock mechanism 100. The gear cover 26 is affixed with screws to the underside of the face panel 66. The gear cover 26 is irregularly shaped; near to the fuse access door 140 it is generally elongated, narrow and deep, while towards either end of the device, it is shallow but occupies a comparatively large area, to accommodate the geometry of the device interlock mechanism 100. An end portion 28 of the gear cover in is indicated in cutaway form in FIG. 2. For convenience in manufacturing, the gear cover is formed in two sections which meet.

The housing cover 24 includes a cap 62 for sealing the plug port which receives plug 60 when the plug 60 is not present. The cap 62 is preferably a twist cap with a rubber liner for sealing with the port 60 when the cap 62 is tightened and is preferably hingeably attached to the housing cover 24. A chain 64 is provided to captivate the housing cover 24 to the base 22. The housing cover 24 further has a rectangular opening, whereat is located the rectangular fuse access door 140 with an edge which is affixed with hinges 142 to one side of the face panel 66. The door has a free edge opposite the hinged edge. When open, the door 140 provides access to fuse pullers 144, from each of which depend fuses. When the device is operable, the fuses are disposed in a fuse block 146 between the switch 50 and the receptacle 72, in series therewith. When the door is open, only the fuse block 146 is accessible, access to any other area beyond the fuse block 146 such as live connections near the switch being precluded by a skirt 141 which depends from around the opening of the housing cover 24.

When closed, the door 140 is secured to the face panel 66 with a pair of quarter turn screws 148. The screws 148 are so mounted that they remain attached to the door when they are disengaged from the face panel 66. A window area 150 in the door 140 lines up with the fuse puller 144, so that when the door is closed, blown fuse indicators are visible. The housing cover 24 also includes a lever arm port which extends through one of the side panels 68 and accommodates a pivot end 88 of the lever arm 80.

Figure 2:
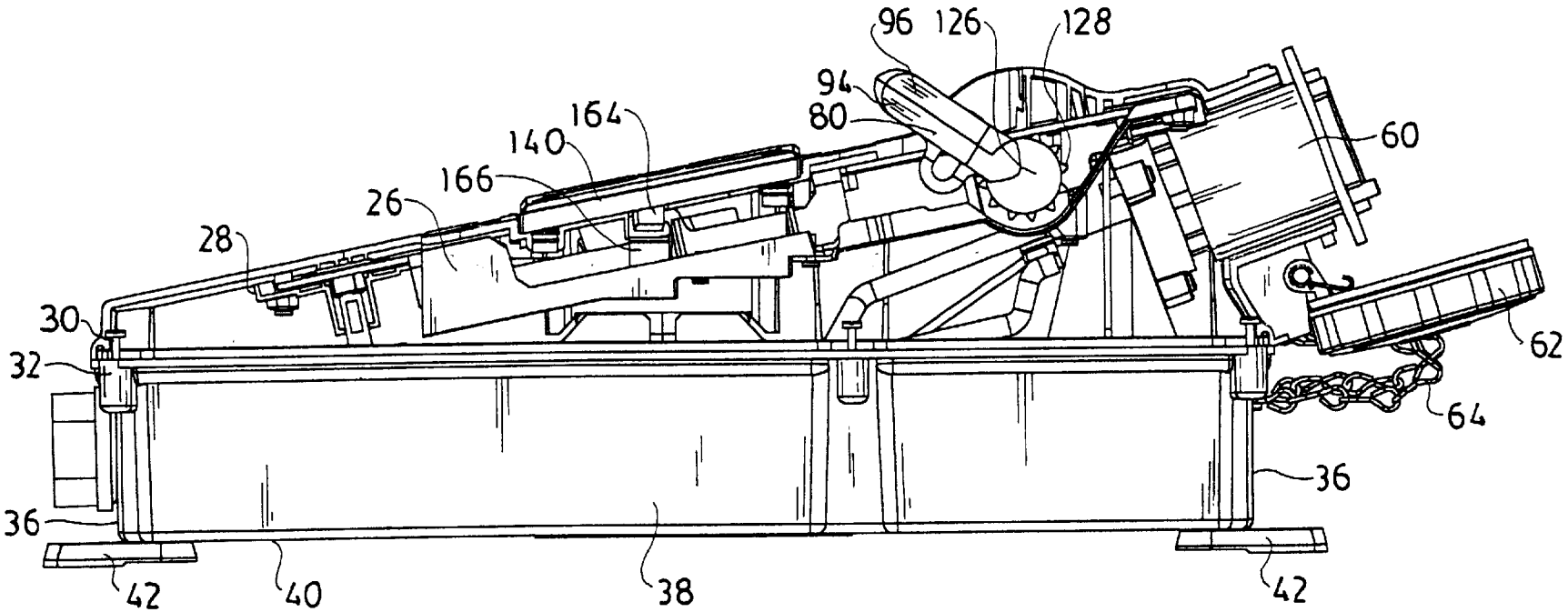
FIG. 2 is an elevation view of the device of FIG. 1, viewed from the side opposite to the view in FIG. 1, with the cover partly cut away to show a device interlock mechanism.
Figure 3:
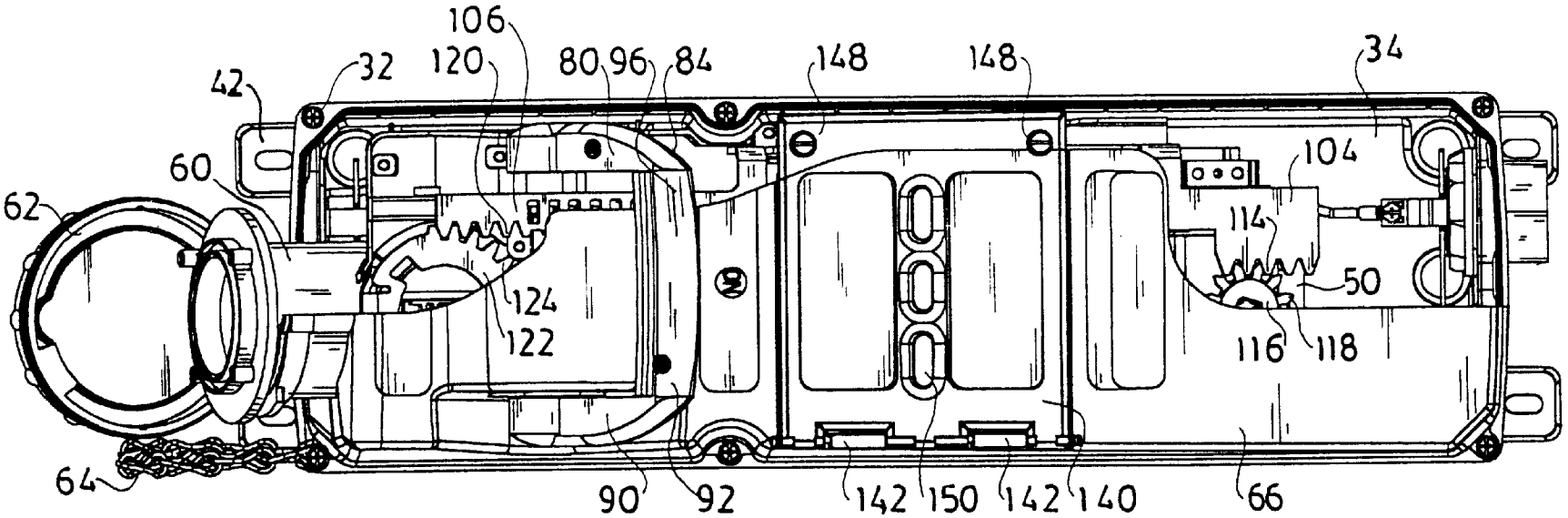
FIG. 3 is a plan view of the device of FIG. 1, with the housing partly cut away to show the interlock mechanism.
Figure 4:
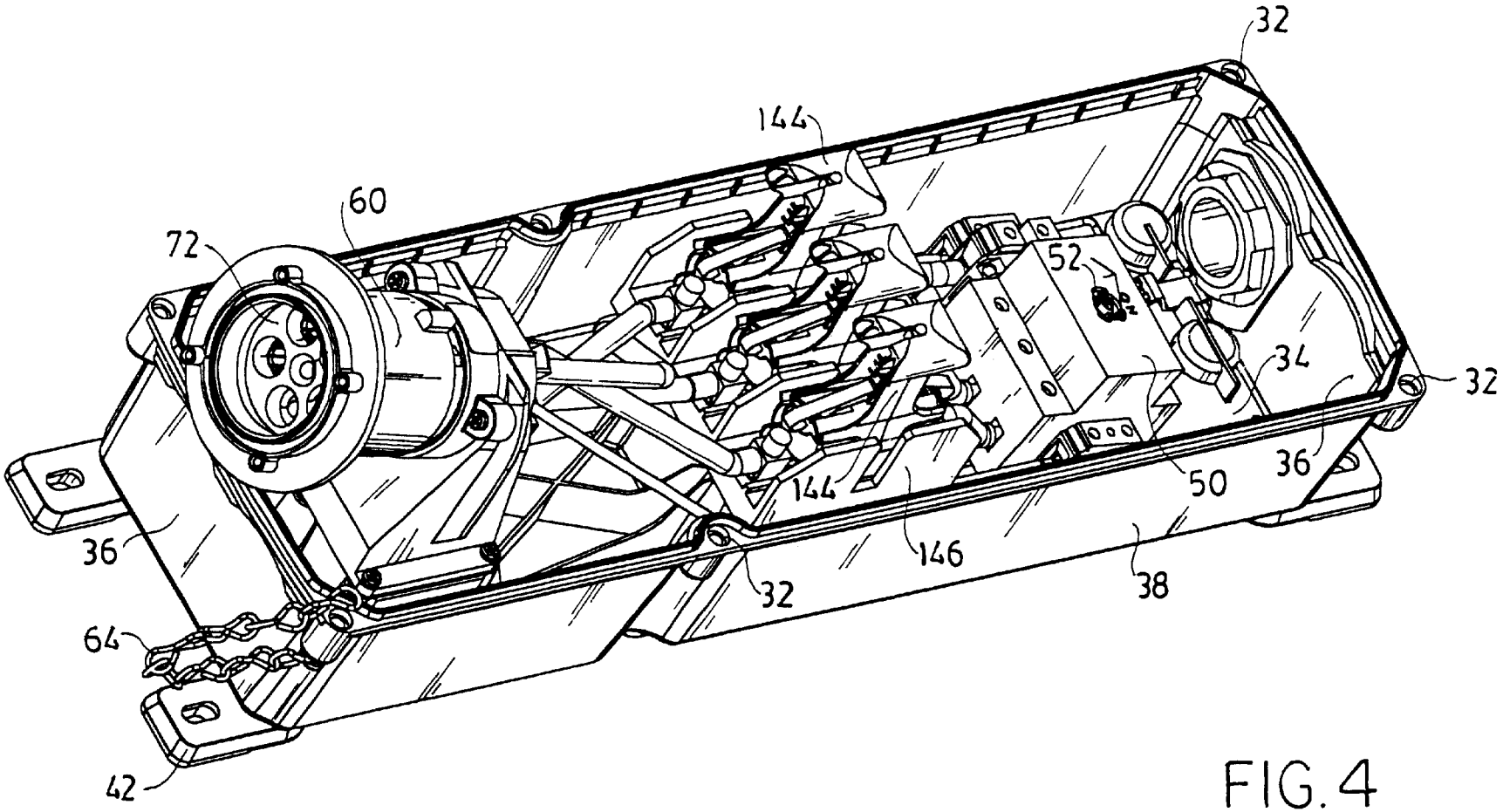
FIG. 4 is a perspective view of the device of FIG. 1 with the cover and the interlock mechanism removed.
Figure 5:
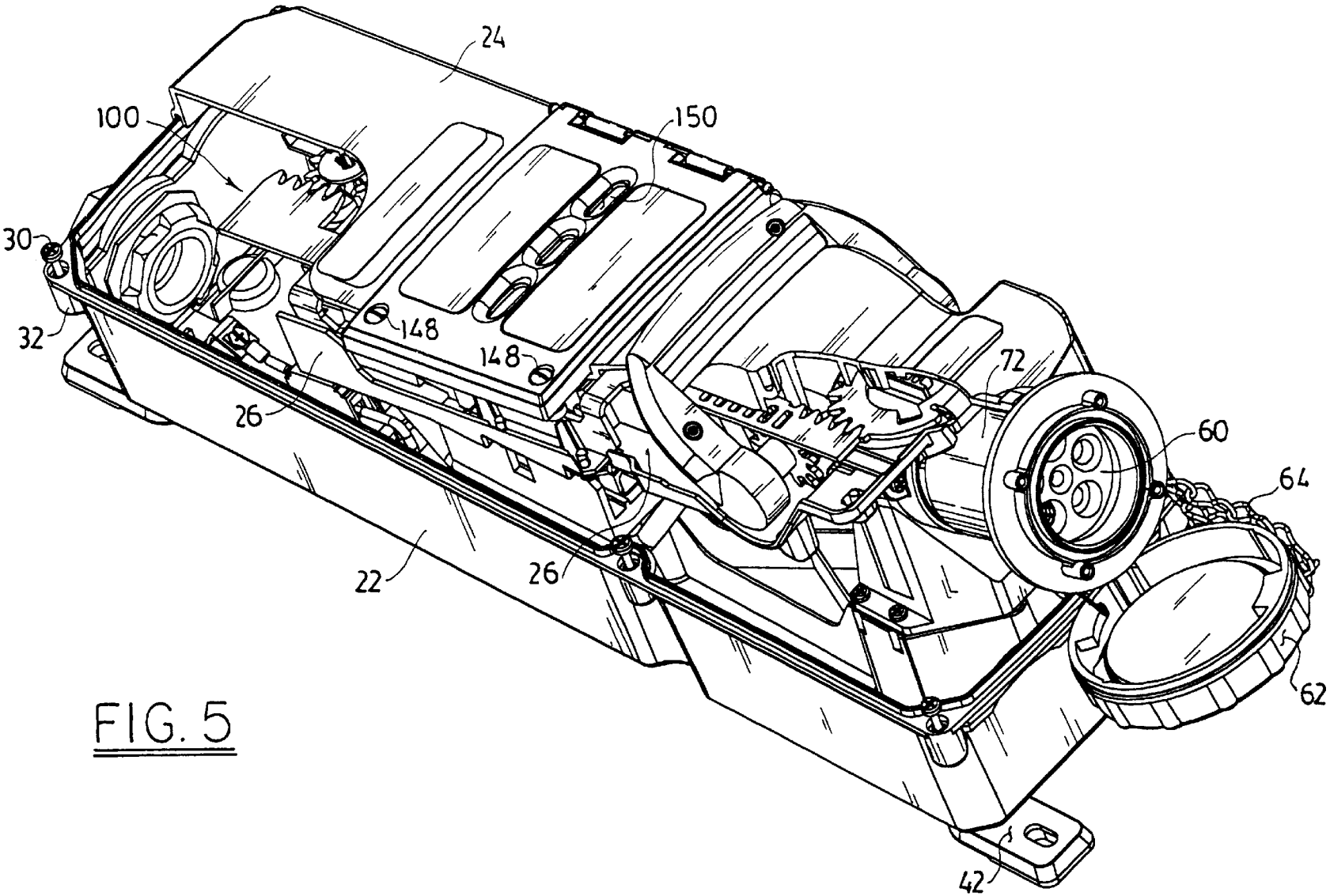
FIG. 5 is a perspective view of the device of FIG. 1 with the cover partly cut away to show the interlock mechanism.
Figure 6:
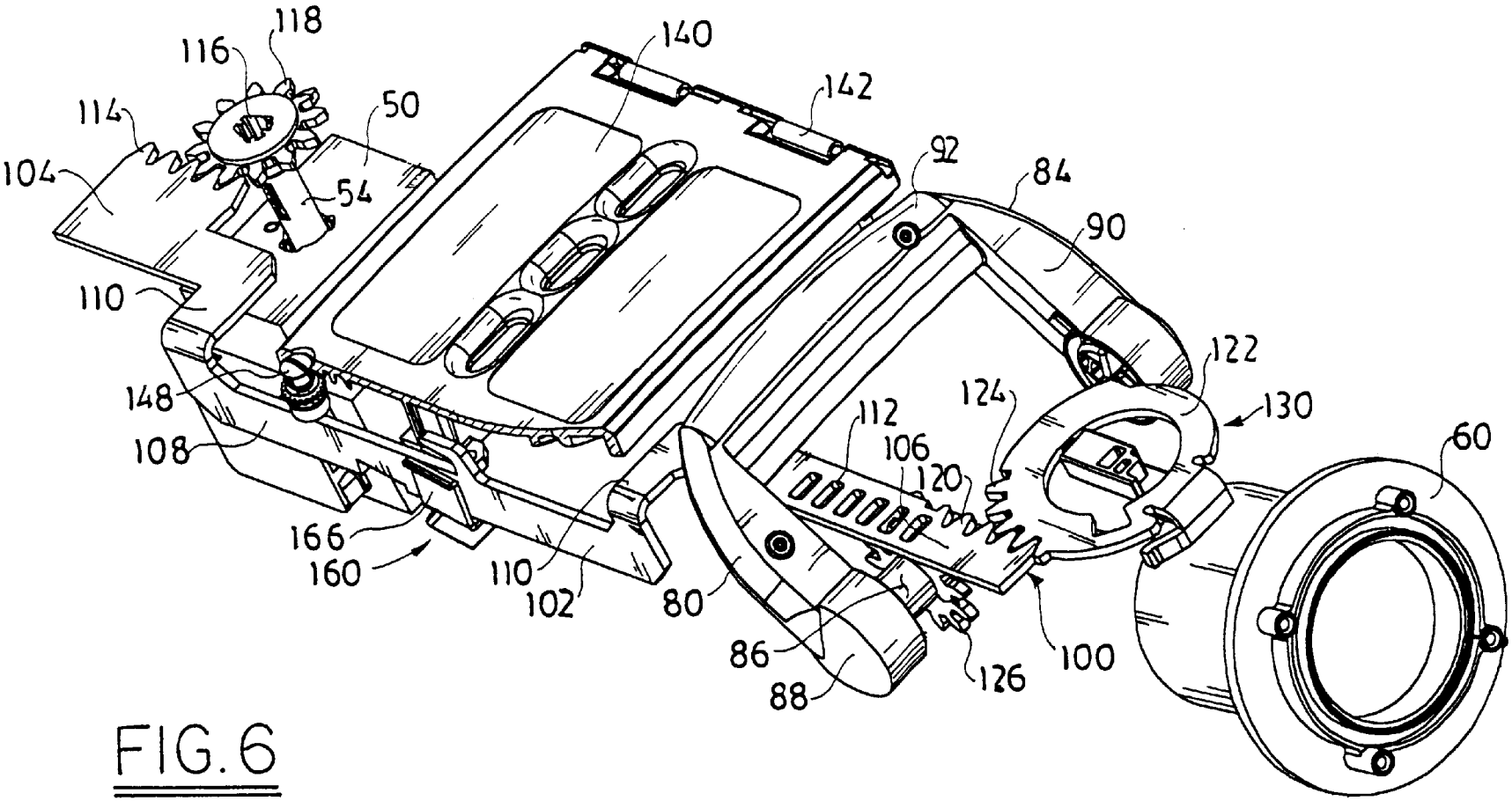
FIG. 6 is the same perspective view as FIG. 3 with the housing removed, essentially leaving the interlock mechanism and a fuse access door.

Referring to FIG. 6, the lever arm 80 is connected to a lever arm drive shaft 86 which is sealably mounted to the lever arm port and extends into the housing 20. As seen in FIG. 2, a transfer gear 126 is mounted on an inner portion of the drive shaft 86 for rotation therewith in response to movement of the lever arm 80. The lever arm 80 may form part of a handle which can have any of a variety of shapes such as a "U" shape, "L" shape or "T" shape. In the preferred embodiment, best seen in FIG. 3,5 or 6, the combination of the lever arm 80 with a second lever arm 90 and a cross member 92 forms a substantially U-shaped handle 84. The second lever arm 90 is attached to an outer surface of the housing cover 24 by a suitable pivoting fastener, and the cross member 92 is fixedly joined to the ends of the lever arms 80 and 90 which are more distant from the housing. This fire alarm type handle 84 thus is pivoted on two handle ends on a common axis extending through the housing 20. In addition, the handle 84 includes contrasting colors, wherein a first one of the contrasting colors 94, for example black, is predominately visible when the handle 84 is in the OFF position and the second contrasting color 96, for example red, is predominately visible when the handle 84 assumes the ON position.

The receptacle 72 is mounted in the base 22 and electrically connected to the switch 50, and is aligned with the plug port to receive the plug 60 when it is inserted through the port. The electrical plug for connecting to the receptacle 72 is preferably of the pin and sleeve type, and being well known, will not be further described. The device interlock mechanism 100 includes a plug interlock gear 122 which engages with the plug via a plug interlock assembly 130. The assembly 130 will not be described in detail, having been disclosed in U.S. Pat. No. 5,880,420 to Rohmer, incorporated herein by reference. FIG. 6 shows general features of the plug interlock assembly 130, which has an enabling position and a disabling position relative to possible movement of a driver bar 102 that is slidably mounted with respect to the housing cover 24, and specifically to the inside of the face panel 66. In the enabling position, which is operative when the plug is properly inserted in the receptacle 72, the plug interlock assembly 130 allows the plug interlock gear 122 to be rotated. The disabling position of the plug interlock assembly 130 prevents rotation of the plug interlock gear 122.

Figure 7:
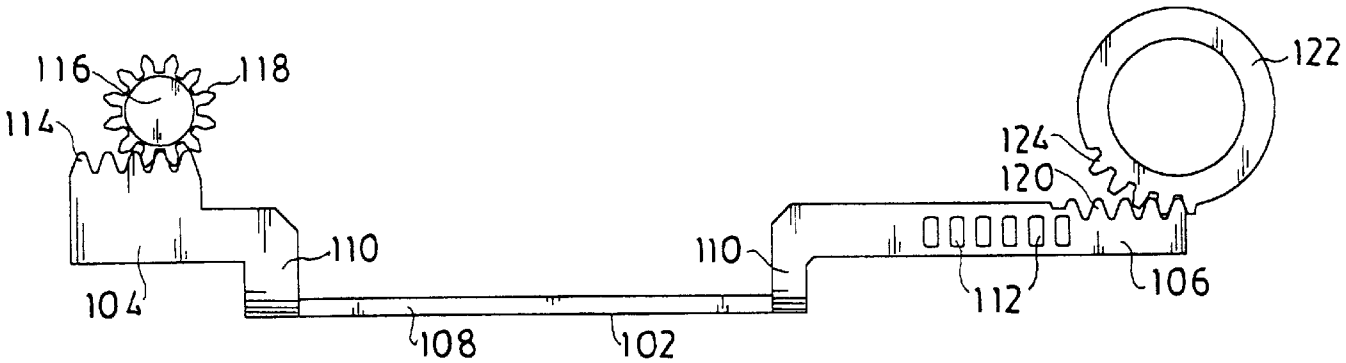
FIG. 7 shows a semi-schematic plan view of a driver bar engaging with an actuation gear and a plug interlock gear.

The conventional electrical switch 50 is mounted inside the base 22, the switch 50 having a rotatable switch shaft 52 which is connected by a coupling shaft 54 to an actuation gear 116 which is axially mounted thereon. The driver bar 102 extends between the actuation gear 116 and the plug interlock gear 122, with both of which it is operably engaged, as illustrated in FIGS. 6 and 7. The bar 102 is integrally formed from flat metal sheet of sufficient thickness to provide rigidity.

Figure 8:
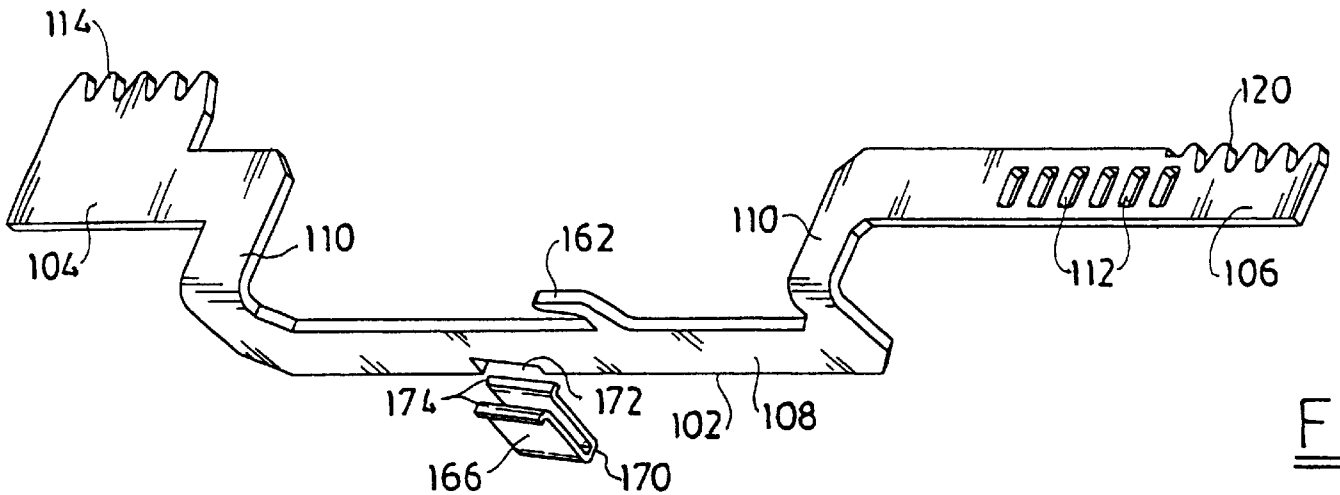
FIG. 8 shows a perspective view of the driver bar and a lockout.

Referring to FIGS. 7 and 8, the bar 102 has a first end portion 104 near to the actuation gear 116 and a second end portion 106 near to the plug interlock gear 122, the end portions being commonly aligned in a plane parallel to the base 22 of the housing 20. An elongated U-shaped central portion 108 of the driver bar 102 lies in a plane parallel to the side walls 38 of the housing 20, the plane being proximate with the free edge of the fuse access door 140. The end portions 104 and 106 are inwardly displaced from the plane of the central portion 108, and joined thereto by extending portions 110 which connect with the top ends of the U. Along the first end portion 104 of the driver bar 102 is a first set of gear engaging surfaces, preferably a plurality of teeth 114, which engage with a plurality of teeth 118 at the circumference of the actuation gear 116. Along the second end portion 106 of the driver bar 102 is a second set of gear engaging surfaces, preferably a plurality of teeth 120, engaging with a plurality of teeth 124 at the circumference of the plug interlock gear 122.

The driver bar 102 has a third set of gear engaging surfaces which are intermediate the first and second gear engaging surfaces 114 and 120. The third gear engaging surfaces are preferably a plurality of slots 112 within the perimeter of the bar. The slots 112 are cooperatively aligned with teeth 128 at the circumference of the transfer gear 126 in a substantially rack and pinion relationship. Movement of the lever arm 80 causes the drive shaft 86 to rotate, along with the transfer gear 126. The rotation of the transfer gear 126 accordingly urges the driver bar 102 to move in a linear direction. However, the plug interlock precludes motion of the driver bar 102 unless the plug is properly inserted in the receptacle 72. The device interlock mechanism 100 includes a fused mechanical interlock (FMI) 160. This provides a further interlocking mechanism, which secures the fuse access door 140, precluding it from being in the open position while the device is energized.

Figure 9:
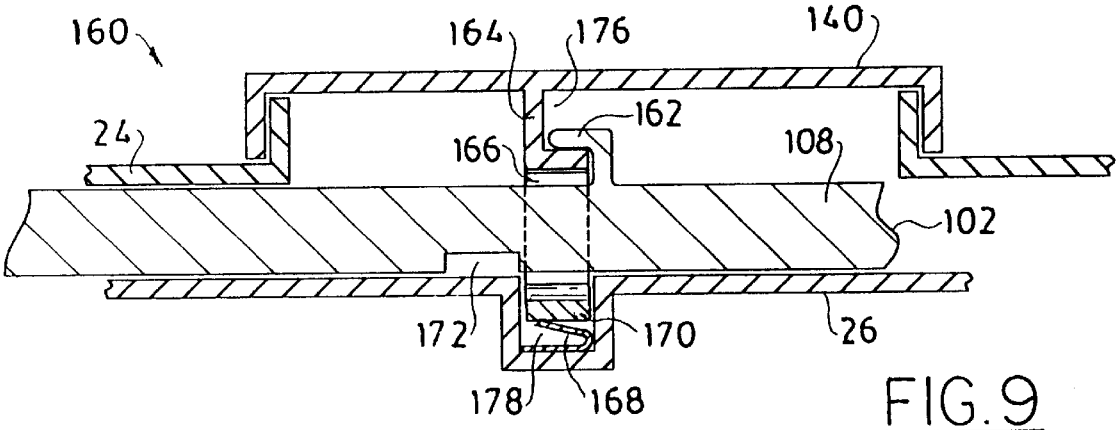
FIG. 9 schematically shows a portion of a fused mechanical interlock in an operational configuration.
Figure 10:
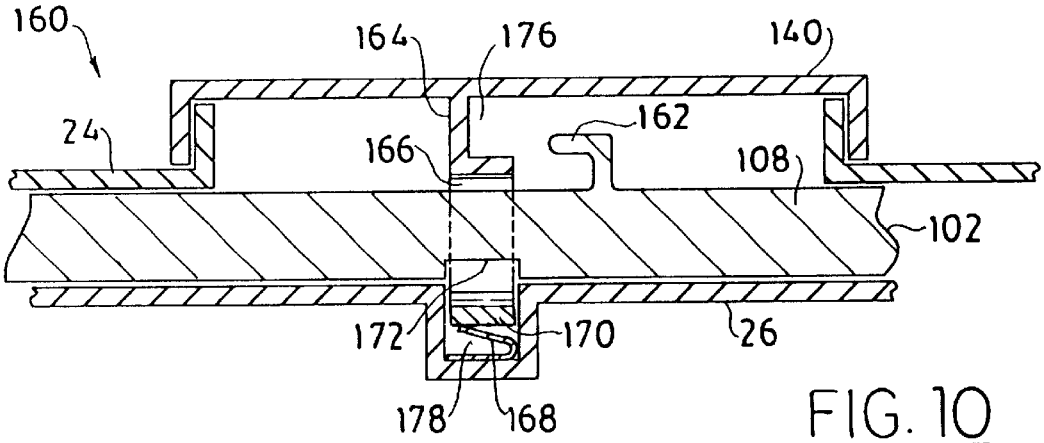
FIG. 10 schematically shows a portion of a fused mechanical interlock in a different operational configuration from FIG. 9.
Figure 11:
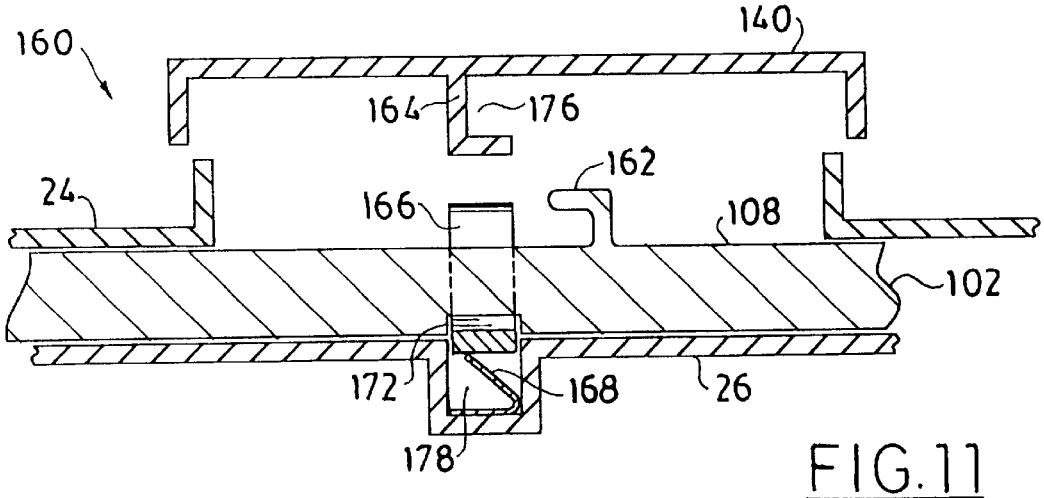
FIG. 11 schematically shows a portion of a fused mechanical interlock in a different operational configuration from FIGS. 9 and 10.

FIGS. 9, 10, and 11 schematically show the FMI 160 viewed from the side of the device in three different operating positions. The mechanism ensures that the door 140 cannot be opened when the device 10 is energized, and also that the device 10 cannot be energized while the door 140 is open. In FIG. 9, the door is closed and secured to the housing 20 by the quarter-turn screws 148 and the driver bar 102 is disposed in the ON position. The driver bar 102 has a hooked portion 162 disposed along its upper edge and projecting towards the switch end of the device. In the ON position, the hooked portion 162 engages a door catch 164 on the inside of the door 140, so preventing the door from being opened. A lockout 166 is located atop an angled flat spring 168 beneath the driver bar 102 and directly opposite the door catch 164.

Figure 12:
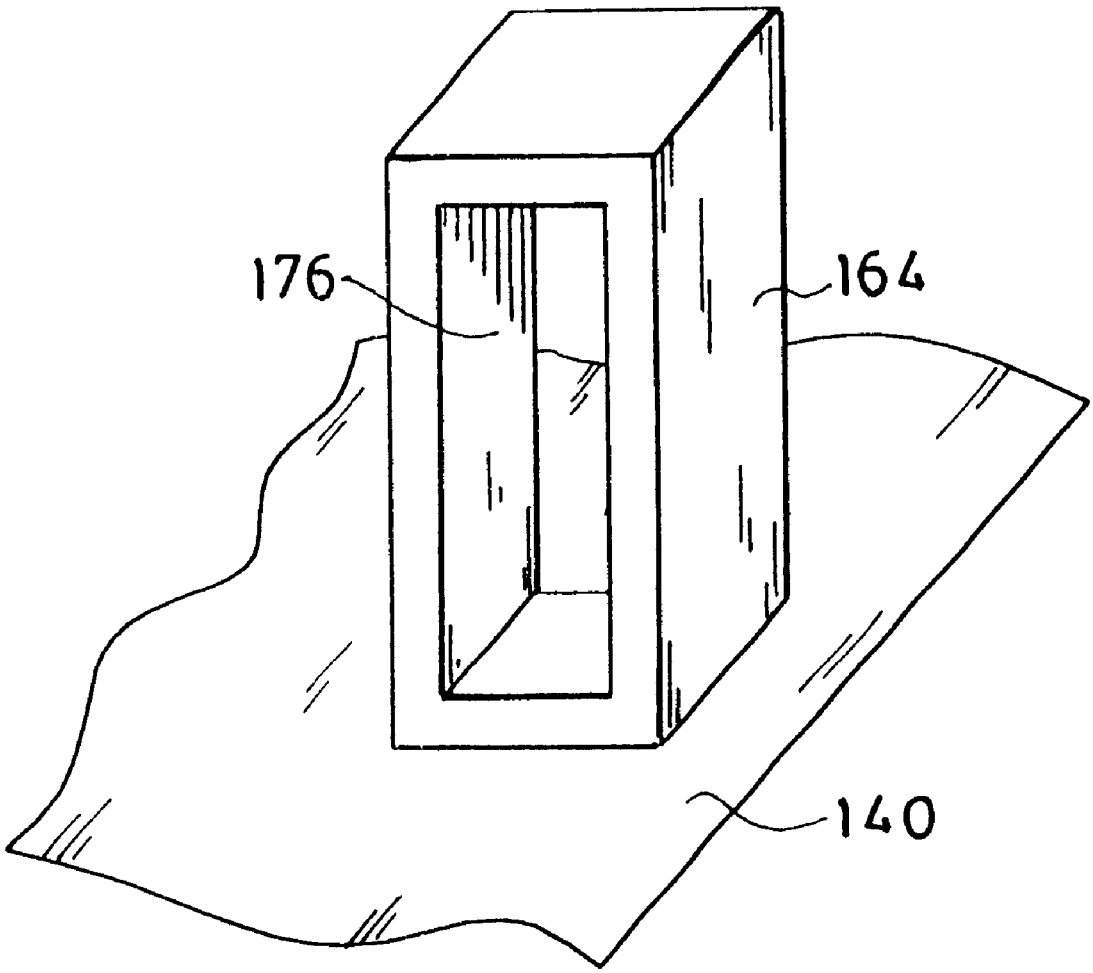
FIG. 12 schematically shows a door catch and a portion of the door.

As best seen in FIG. 8, the lockout 166 is basically a U-shaped bracket in a sliding relationship with the central portion 108 of the driver bar 102. A bottom portion 170 of the lockout 166 can engage with a notch 172 along the lower edge of the central portion 108 of the driver bar 102. With the driver bar 102 in the ON position of FIG. 9, the notch 172 is laterally displaced from the lockout 166. Atop each side of the U, the lockout 166 has lips 174 whereon the door catch 164 presses when the door is closed, so that the lockout is held down and exerts a compressive force against the spring 168. As shown schematically in FIG. 12, the door catch is effectively a rectangular block which is integrally formed with the door. An appropriate face of the block has an opening 176 for receiving the hooked portion 162. The spring 168 is nested in a recess 178 within the gear cover 26, the recess also providing space to accept downward displacement of the lockout 166.

In FIG. 10 the driver bar 102 has been translated away from the switch end of the device to the OFF position, and its hooked portion 162 has disengaged from the door catch 164. The notch 172 is aligned with the lockout 166, but with the door 140 still held closed against the face panel 66 by the quarter turn screws 148, the door catch 164 continues to urge the lockout 166 downward against the spring 168, which is therefore still under compression.

FIG. 11 shows the door open, after the disengagement of the quarter turn screws 148 from the face panel 66. The pressure of the spring 168 on the bottom portion 170 of the lockout 166 has displaced it upward until the bottom portion 170 is engaged with the notch 172, so immobilizing the driver bar 102. This displacement of the lockout 166 has in turn partially urged open the door 140. With the switch 50 in the OFF position, the door 140 can be fully opened and any blown fuses can be replaced.

The door 140 must be closed again and secured to the face panel 66 with the quarter turn screws 148, in order to disengage the bottom portion 170 of lockout 166 from the notch 172, and restore the configuration of the FMI to that of FIG. 10. The hooked portion 162 is now re-engaged with the door catch 164, and the device can be energized by moving the driver bar 102 to the ON position depicted in FIG. 9. While the FMI 160 and the plug interlock gear 122 are mechanically linked, the proper functioning of the plug interlock gear 122 does not require that the door 140 be opened. Normally, with the device in the OFF position, the door would remain secured to the face panel 66, unless it were necessary to replace a fuse.

The FMI of the invention can be incorporated into electrical switching devices having the plug interlock mechanism which are designed to carry various currents. Typically, 20, 30 and 60 amp devices have similar external dimensions, being approximately 24" long, 6" wide and 10" deep at the deepest point. The only dimensional differences are with regard to the switch 50, the fuse block 146 and the receptacle 72; the device interlock mechanism 100 is identically sized in all these cases, the driver bar 102 being about 15" long. With 100 amp devices, the length of the housing must be extended to accommodate larger electrical components, and the driver bar 102 is correspondingly about 3" longer.

Operation

It is assumed that the device is energized, i.e., in the ON position, and it is necessary to replace a fuse. When the handle 84 is moved to its OFF position, the driver bar 102 moves linearly so that the notch 172 is aligned with the lockout 166. The fuse access door 140 is released by loosening the quarter-turn screws 148 from the face panel 66. The door 140 is now only joined to the face panel 66 at the hinges 142, and the door catch 164 no longer constrains the lockout 166 from movement. The pressure of the spring 168 urges the lockout 166 upward to engage the bottom portion 170 with the notch 172 of the driver bar 102. The driver bar 102 is now immobilized, and cannot be moved back to the ON position. The fuse puller 144 is removed from the fuse block 146 and blown fuses are replaced. Once any necessary action has been taken to locate and correct the cause of any blown fuses, the fuse access door 140 is closed and secured to the face panel 66 with the quarter-turn screws 148. Securing the fuse access door 140 causes the door catch 164 to be pushed downward on the lockout 166 and overcome the upward pressure of the spring 168. The bottom portion 170 of the lockout 166 is no longer engaged with the notch 172. Assuming that the plug is properly inserted in the receptacle 72 and that the plug interlock is released, the driver bar 102 is now free to move, and is restored to the ON position by a corresponding movement of the switch handle 84.

While the present invention has been described with reference to a particular preferred embodiment and the accompanying drawings, it will be understood by those skilled in the art that the invention is not limited to the preferred embodiment and that various modifications and the like could be made thereto without departing from the scope of the invention as defined in the following claims.

What is claimed is:

1. An electrical switching device comprising:

a housing;

an electrical switch for energizing an electrical circuit when the switch is closed and de-energizing the electrical circuit when the switch is open;

a fuse block connected in series with the switch;

a fuse access door in the housing providing access to the fuse block but not to the switch; and a mechanical interlock operably connecting the fuse access door and the switch, which prevents the switch from being closed when the door is open, and prevents the door from being opened when the switch is closed.

2. The device of claim 1, wherein the mechanical interlock comprises a driver bar operably connecting the switch to a door catch attached to the door.

3. The device of claim 2, further comprising an actuation gear which is coupled to the switch and engages the driver bar.

4. The device of claim 3, wherein the driver bar cooperates with a lockout and with the door catch so as to preclude the door from being opened when the circuit is energized and further to preclude the circuit from being energized when the door is open.

5. The device of claim 2, further comprising:

a plug interlock mechanism with an enabling and a disabling position, and a plug interlock gear cooperating with the plug interlock mechanism, wherein the driver bar cooperates also with the plug interlock gear such that the driver bar can only be in the ON position when enabled by the plug interlock mechanism.

6. An electrical switching device having a housing, comprising:

(a) an electrical switch with an OFF and an ON position wherein the device is respectively de-energized and energized;

(b) an actuation gear coupled to the switch;

(c) at least one fuse block designed to hold a fuse in series with the switch;

(d) a fuse access door in the housing, which provides the only access to the fuse block, access beyond the fuse block being precluded;

(e) a door catch attached to the door;

(f) a lockout disposed against a spring and cooperating with the door catch; and (g) a driver bar cooperating with the actuation gear and the lockout, wherein the driver bar is slidably mounted with respect to the housing so as to be selectably displacable between an OFF and an ON position, corresponding respectively with the OFF and ON positions of the switch;

the driver bar includes a notch which aligns with the lockout when the driver bar is in the OFF position such that if the door is open the spring can urge the lockout upward so that a portion thereof engages with the notch, precluding the driver bar from moving to the ON position until the door is closed; and the driver bar further including a hooked portion so that when the diver bar is in the ON position and the door is closed, the hooked portion engages with the door catch and precludes the door from being opened.

7. The device of claim 6, having further a plug interlock mechanism with an enabling and a disabling position, and a plug interlock gear cooperating with the plug interlock mechanism, wherein the driver bar cooperates also with the plug interlock gear; it being also provided that the driver bar can only be in the ON position when enabled by the plug interlock mechanism.

8. The device of claim 7, wherein when the fuse access door is fully closed, the door catch urges the lockout downward against the opposition of the spring so that the lockout is not engaged with the notch and does not impede the selective displacement of the driver bar.

9. The device of claim 8, further comprising a transfer gear cooperating with the driver bar.

10. The device of claim 9, wherein rotation of the transfer gear slidably displaces the driver bar when its displacement is not impeded by the lockout or by the plug interlock gear.

11. The device of claim 6, wherein when the fuse access door is fully closed, the door catch urges the lockout downward against the opposition of the spring so that the lockout is not engaged with the notch and does not impede the selective displacement of the driver bar.

12. The device of claim 11, further comprising a transfer gear engaging with the driver bar.

13. The device of claim 12, wherein rotation of the transfer gear slidably displaces the driver bar when its displacement is not impeded by the lockout.

14. The device of claim 13, further comprising a drive shaft, the transfer gear being operably connected to the drive shaft.

15. The device of claim 14, further comprising a handle which is attached to the drive shaft.

16. The device of claim 15, wherein the handle includes a first and a second contrasting color, the handle being switchable between an OFF position and an ON position, wherein the first contrasting color is predominately visible when the handle is in the OFF position and the second contrasting color is predominately visible when the handle is in the ON position.

17. The device of claim 15, further comprising a housing cover which pivotally supports the handle.

18. The device of claim 17, further comprising a base stop which fits a housing cover.

19. The device of claim 18, wherein the interlock gear has teeth along at least a portion of its circumference, the transfer gear has teeth along at least a portion of its circumference, and the actuation gear has teeth along at least a portion of its circumference.

20. The device of claim 19, wherein the driver bar has teeth along at least a part of each end portion.

21. The device of claim 20, wherein the driver bar comprises slots for retaining gear teeth.

22. The device of claim 21, wherein the driver bar is integrally formed with end portions lying in the same plane and a central portion lying in a plane perpendicular to the plane of the end portions.

23. The device of claim 22, wherein the central portion has substantially the shape of an elongated "U. "

24. The device of claim 23, wherein the end portions are lineraly aligned with each other, and each end portion is joined to a coplanar extending member by which it is attached to the central portion at an upper estremity of the elongated "U. "

25. The device of claim 24, wherein the teeth along each end portion of the driver bar are directed away from the plane of the central portion thereof.

26. The device of claim 25, wherein the hooked portion of the driver bar extends upwardly from the central portion thereof.

27. The device of claim 26, wherein the notch in the driver bar is disposed in a lower edge of the central portion thereof.

28. The device of claim 27, wherein the teeth of the transfer gear mesh with the slots of the driver bar to slidably displace the driver bar in a linear direction.

29. The device of claim 28, wherein the teeth of the interlock gear mesh with the teeth from one of the two ends of the driver bar to rotatably move the interlock gear and wherein the teeth of the actuation gear mesh with the teeth of the other of the two ends of the driver bar to rotatably move the actuation gear.

30. The device of claim 29, wherein the lockout is an upright U-shaped bracket, having a bottom portion which engages with the spring and can engage with the notch, and having also a lip at an upper extremity which can engage with the door catch.

* * * * *